US011988441B2

(12) United States Patent
Du et al.

(10) Patent No.: US 11,988,441 B2
(45) Date of Patent: May 21, 2024

(54) REFRIGERATOR MANAGEMENT METHOD, REFRIGERATOR MANAGEMENT DEVICE, REFRIGERATOR MANAGEMENT SYSTEM, AND TEMPERATURE CALCULATION METHOD

(71) Applicant: Panasonic Intellectual Property Management Co., Ltd., Osaka (JP)

(72) Inventors: Wanjing Du, Kyoto (JP); Yuji Osaki, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 296 days.

(21) Appl. No.: 17/423,385

(22) PCT Filed: Oct. 15, 2020

(86) PCT No.: PCT/JP2020/038890
§ 371 (c)(1),
(2) Date: Jul. 15, 2021

(87) PCT Pub. No.: WO2021/075493
PCT Pub. Date: Apr. 22, 2021

(65) Prior Publication Data

US 2022/0065523 A1 Mar. 3, 2022

(30) Foreign Application Priority Data

Oct. 18, 2019 (JP) ..... 2019-191083

(51) Int. Cl.
*F25D 29/00* (2006.01)
*F25B 49/02* (2006.01)

(52) U.S. Cl.
CPC ..... *F25D 29/00* (2013.01); *F25B 49/022* (2013.01); *F25B 2500/06* (2013.01);
(Continued)

(58) Field of Classification Search
CPC .... F25D 29/00; F25B 49/022; F25B 2500/04; F25B 2500/06; F25B 2700/02; F25B 2700/2104
See application file for complete search history.

(56) References Cited

U.S. PATENT DOCUMENTS

2015/0150088 A1 5/2015 Haga et al.
2016/0127144 A1 5/2016 Takahashi et al.
2020/0018537 A1 1/2020 Miwa

FOREIGN PATENT DOCUMENTS

CN 108895759 A 11/2018
CN 109960296 A 7/2019
(Continued)

OTHER PUBLICATIONS

International Search Report issued in corresponding International Patent Application No. PCT/JP2020/038890, dated Nov. 24, 2020, with English translation.
(Continued)

*Primary Examiner* — Jonathan Bradford
(74) *Attorney, Agent, or Firm* — Rimon P.C.

(57) ABSTRACT

A refrigerator management method according to one aspect of the present invention includes: obtaining log information including temperature information indicating an interior temperature of a refrigerator and opened and closed information indicating whether or not a door of the refrigerator has been opened and closed; calculating, based on the log information, a timewise change in the interior temperature for when the door is opened and closed in a predetermined period and for when the door is not opened and closed in the predetermined period; and outputting result information indicating a calculation result calculated in the calculating.

11 Claims, 9 Drawing Sheets

(52) U.S. Cl.
CPC .. *F25B 2700/2104* (2013.01); *F25D 2500/04* (2013.01); *F25D 2700/02* (2013.01); *F25D 2700/12* (2013.01)

(56) References Cited

FOREIGN PATENT DOCUMENTS

| | | | |
|---|---|---|---|
| EP | 2708834 | A1 | 3/2014 |
| JP | H04-306474 | A | 10/1992 |
| JP | 2005-274059 | A | 10/2005 |
| JP | 2011-058796 | A | 3/2011 |
| JP | 2013-234845 | A | 11/2013 |
| JP | 2015-28760 | A | 2/2015 |
| JP | 6-137747 | B2 | 5/2017 |
| JP | 2019-132550 | A | 8/2019 |
| JP | 2019-160109 | A | 9/2019 |
| WO | 2005/111519 | A1 | 11/2005 |
| WO | 2014/171119 | A1 | 10/2014 |
| WO | 2018/116520 | A1 | 6/2018 |

OTHER PUBLICATIONS

Office Action issued in corresponding Chinese Patent Application No. 202080009126.9, dated Oct. 28, 2023 w/ English MT.

Chinese Search Report dated Feb. 3, 2024 issued in the corresponding Chinese Patent Application No. 20208009126.9, with English machine translation.

FIG. 3
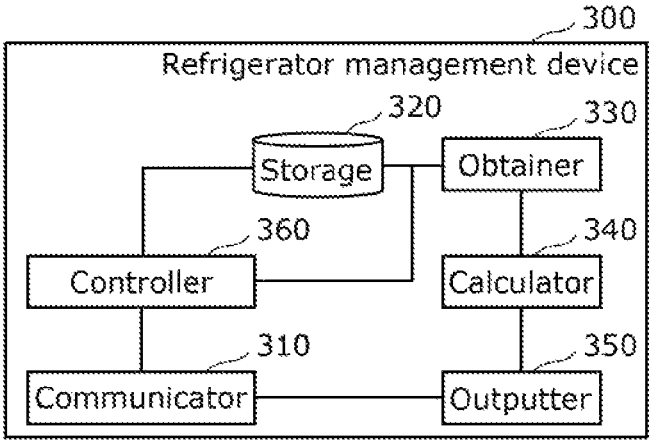
FIG. 4
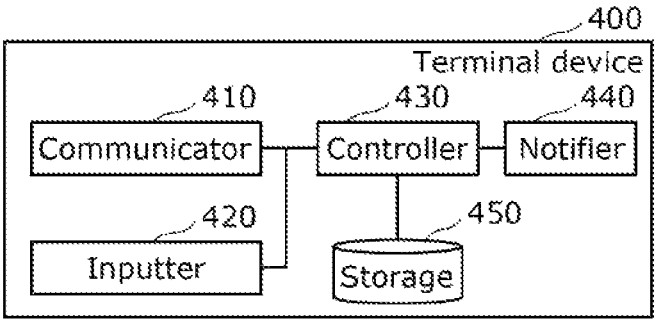
FIG. 5
| Date/time | Interior temperature (°C) | Exterior temperature (°C) | Storage amount | Malfunction sensing result | Compressor rotational frequency (rpm) | Door open/ closed | Power |
|---|---|---|---|---|---|---|---|
| *** | *** | *** | *** | *** | *** | *** | *** |
| 2017/1/20 13:56:00 | 6 | 18 | 5 | Normal | 30 | Closed | On |
| 2017/1/20 13:56:05 | 5 | 18 | 5 | Normal | 25 | Closed | On |
| 2017/1/20 13:56:10 | 5 | 18 | 5 | Normal | 20 | Closed | On |

REFRIGERATOR MANAGEMENT METHOD, REFRIGERATOR MANAGEMENT DEVICE, REFRIGERATOR MANAGEMENT SYSTEM, AND TEMPERATURE CALCULATION METHOD

CROSS-REFERENCE OF RELATED APPLICATIONS

This application is the U.S. National Phase under 35 U.S.C. § 371 of International Patent Application No. PCT/JP2020/038890, filed on Oct. 15, 2020, which in turn claims the benefit of Japanese Application No. 2019-191083, filed on Oct. 18, 2019, the entire disclosures of which Applications are incorporated by reference herein.

TECHNICAL FIELD

The present invention relates to a refrigerator management method, a refrigerator management device, a refrigerator management system, and a temperature calculation method.

BACKGROUND ART

There are conventional techniques in which when an anomaly occurs in a refrigerator, a date/time when the interior temperature of the refrigerator is expected to rise to a predetermined temperature is predicted (e.g., PTL 1 and PTL 2). According to the techniques disclosed in PTL 1 and PTL 2, a user of the refrigerator can determine whether the condition of food stored inside the refrigerator will not deteriorate before repair of the refrigerator is complete.

There is also a technique for predicting a malfunction in a refrigerator based on log information, which is information about the interior temperature of the refrigerator and the like and is stored in the refrigerator (e.g., PTL 3).

CITATION LIST

Patent Literature

[PTL 1] Japanese Unexamined Patent Application Publication No. 6-137747
[PTL 2] International Publication No. 2018/116520
[PTL 3] International Publication No. 2014/171119

SUMMARY OF INVENTION

Technical Problem

There is demand for the ability to accurately predict the interior temperature of a refrigerator when, for example, an anomaly has occurred in the refrigerator and a cooling function of the refrigerator has stopped.

The present invention provides a refrigerator management method and the like that can accurately predict an interior temperature of a refrigerator.

Solution to Problem

A refrigerator management method according to one aspect of the present invention includes: obtaining log information including temperature information indicating an interior temperature of a refrigerator and opened and closed information indicating whether or not a door of the refrigerator has been opened and closed; calculating, based on the log information, a timewise change in the interior temperature for when the door is opened and closed in a predetermined period and for when the door is not opened and closed in the predetermined period; and outputting result information indicating a calculation result of the calculating.

Additionally, a refrigerator management device according to one aspect of the present invention includes: an obtainer that obtains log information including temperature information indicating an interior temperature of a refrigerator and opened and closed information indicating whether or not a door of the refrigerator has been opened and closed; a calculator that calculates, based on the log information obtained by the obtainer, a timewise change in the interior temperature for when the door is opened and closed and for when the door is not opened and closed; and an outputter that outputs result information indicating a calculation result calculated by the calculator.

Additionally, a refrigerator management system according to one aspect of the present invention includes a refrigerator, a refrigerator management device capable of communicating with the refrigerator, and a terminal device capable of communicating with the refrigerator management device. The refrigerator includes: a detector that detects log information including temperature information indicating an interior temperature of the refrigerator and opened and closed information indicating whether or not a door of the refrigerator has been opened and closed; and a transmitter that transmits the log information detected by the detector to the refrigerator management device. The refrigerator management device includes: an obtainer that obtains the log information transmitted from the transmitter; a calculator that calculates, based on the log information obtained by the obtainer, a timewise change in the interior temperature for when the door is opened and closed and for when the door is not opened and closed; and an outputter that outputs result information indicating a calculation result calculated by the calculator. The terminal device includes a notifier that makes a notification of the calculation result based on the result information output from the outputter.

Additionally, a temperature calculation method according to one aspect of the present invention includes: obtaining log information including temperature information indicating an interior temperature of a refrigerator including a compressor, compressor operation information indicating an operation state of the compressor, and opened and closed information indicating whether or not a door of the refrigerator has been opened and closed; and calculating a timewise change in the interior temperature based on a change in the temperature information when the compressor operation information included in the log information indicates a stopped state of the compressor.

Note that these comprehensive or specific aspects may be realized by a system, a method, an integrated circuit, a computer program, or a computer-readable recording medium such as a CD-ROM, or may be implemented by any desired combination of systems, devices, methods, integrated circuits, computer programs, and recording media.

Advantageous Effects of Invention

According to the present invention, a refrigerator management method and the like that can accurately predict an interior temperature of a refrigerator can be provided.

BRIEF DESCRIPTION OF DRAWINGS

FIG. 3 is a block diagram illustrating the functional configuration of a refrigerator management device according to the embodiment.

FIG. 4 is a block diagram illustrating the functional configuration of a terminal device according to the embodiment.

FIG. 5 is a table illustrating an example of log information detected by the refrigerator according to the embodiment.

DESCRIPTION OF EMBODIMENTS

Figure 1:
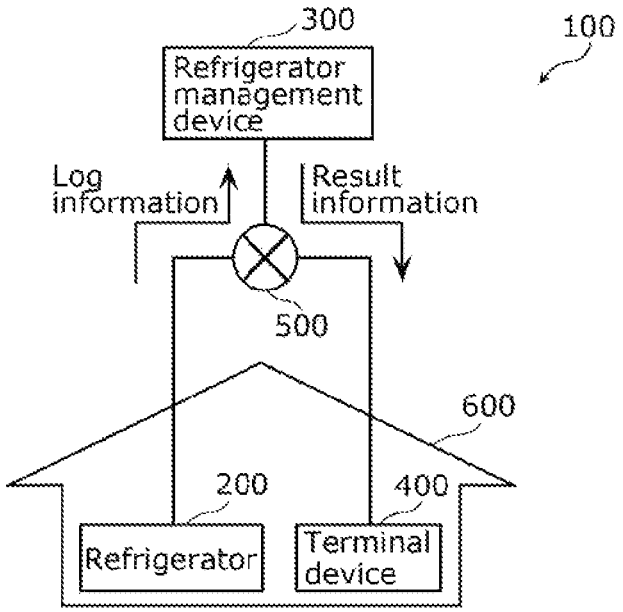
FIG. 1 is a schematic diagram illustrating the overall configuration of a refrigerator management system according to an embodiment.

Hereinafter, a refrigerator management system according to an embodiment of the present invention will be described in detail with reference to the drawings. Note that the following embodiment describes a specific example of the present invention. As such, the numerical values, shapes, materials, constituent elements, arrangements and connection states of constituent elements, steps, orders of steps, and the like in the following embodiments are merely examples, and are not intended to limit the present invention. Thus, of the constituent elements in the following embodiments, constituent elements not denoted in the independent claims, which express the broadest interpretation of the present invention, will be described as optional constituent elements.

Additionally, the drawings are schematic diagrams, and are not necessarily exact illustrations. In the drawings, constituent elements which are the same are given the same reference signs.

Embodiment

Configuration

First, the configuration of a refrigerator management system according to an embodiment will be described with reference to FIGS. 1 to 4.

Overview of Refrigerator Management System

FIG. 1 is a schematic diagram illustrating the overall configuration of refrigerator management system 100 according to the embodiment.

Refrigerator management system 100 includes refrigerator 200, refrigerator management device 300, and terminal device 400. Refrigerator 200, refrigerator management device 300, and terminal device 400 are communicatively connected over network 500, which is the Internet or the like, for example.

Note that refrigerator management system 100 may include a router or the like for refrigerator 200, refrigerator management device 300, and terminal device 400 to communicate. Additionally, refrigerator 200 and terminal device 400 may be communicatively connected over a LAN (Local Area Network), and need not be capable of communicating directly. When refrigerator 200 and terminal device 400 communicate over a LAN, the communication standard which is used is not particularly limited. Wi-Fi (registered trademark) Bluetooth (registered trademark), ZigBee (registered trademark), and the like can be given as examples of the communication standard. Refrigerator 200 is placed inside home 600 where a user resides, for example. Refrigerator management device 300 is placed outside home 600, for example.

When, for example, a cooling function of refrigerator 200 has stopped due to a malfunction in refrigerator 200 or the like, the interior temperature of refrigerator 200 will begin to rise gradually. If food items, such as vegetables, are stored inside and are left for a long period of time, those food items will deteriorate more rapidly than when the cooling function of refrigerator 200 is maintained, due to the rise in the interior temperature. The extent to which food items deteriorate differs depending on the interior temperature. Accordingly, knowing the interior temperature of refrigerator 200 when the cooling function has stopped enables the user to make a decision on the food items stored inside, such as whether the food items should be consumed, or continue to be stored because refrigerator 200 will be repaired in time.

Refrigerator management system 100 is a system in which refrigerator management device 300 calculates (estimates) a timewise change in the interior temperature of refrigerator 200 (also called a "temperature change") based on log information of refrigerator 200 detected by refrigerator 200, and a user is notified of the result of the calculation (a calculation result) through terminal device 400 used by the user. To be more specific, refrigerator management system 100 calculates the timewise change in the interior temperature both for when door 280 (see FIG. 2) of refrigerator 200 is not opened and closed in a predetermined period and for when door 280 is opened and closed in the predetermined period.

Note that the predetermined period may be determined as desired in advance, or may be set by the user.

In the following descriptions, door 280 being opened and closed refers to an operation of opening door 280 of refrigerator 200 and then closing door 280, with the basic state of door 280 being a closed state. Door 280 not being opened and closed refers to a state in which door 280 remains closed.

The log information is data pertaining to processing (operations) performed by refrigerator 200, operations of refrigerator 200 performed by the user, and so on. The log information can include various types of information obtainable from refrigerator 200, such as, for example, information indicating an operation status or an operation date/time of refrigerator 200.

In the present specification, "user" refers to a user of terminal device 400, i.e., a user who confirms a calculation result from refrigerator management device 300 using refrigerator management system 100. Specifically, the "user" is a user who uses refrigerator management system 100 to be provided with log information analysis results and the like from refrigerator management device 300. For example, in a typical household, a head of household who enters into a use contract with a business that manages refrigerator management system 100 is the "user". Additionally, for example, for business use, a company, corporation, individual, or the like that enters into a use contract with a business that manages refrigerator management system 100 is the "user". Additionally, for example, in a typical household, the user and the user's family are both the owners of refrigerator 200 which provides the log information and the users of refrigerator 200. The "user" may be separate from the user of the refrigerator. In the present embodiment, the "user" and the user of refrigerator 200 are the same.

Additionally, although FIG. 1 illustrates one each of refrigerator 200 and terminal device 400, the numbers of refrigerator 200 and terminal device 400 included in refrigerator management system 100 are not particularly limited, and may be pluralities.

The configurations of refrigerator 200, refrigerator management device 300, and terminal device 400 will be described in detail hereinafter.

Refrigerator

Figure 2:
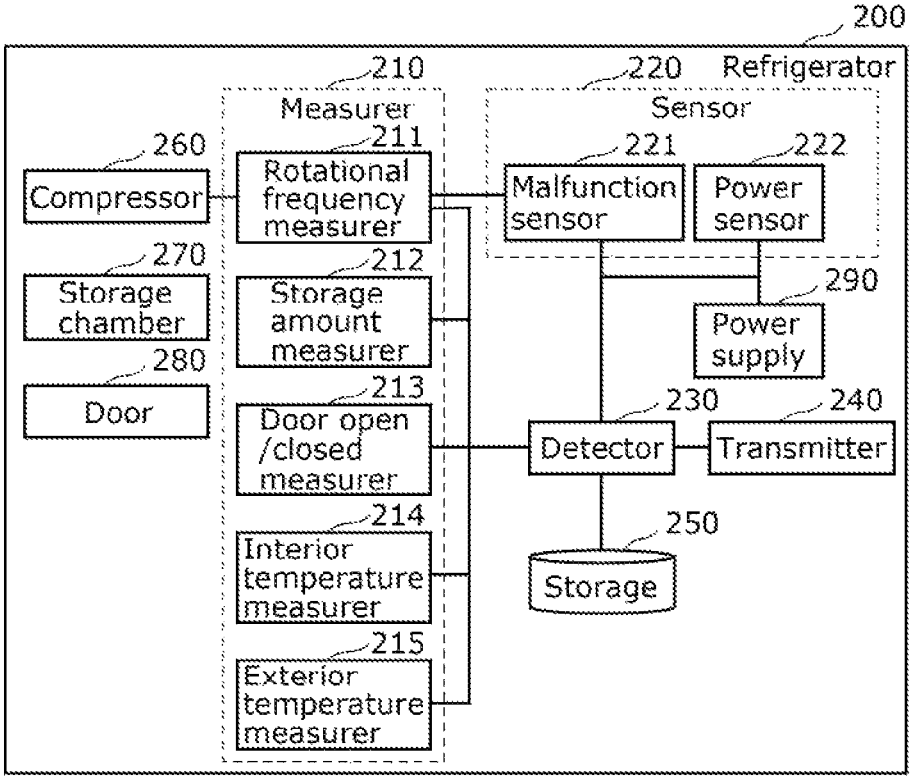
FIG. 2 is a block diagram illustrating the functional configuration of a refrigerator according to the embodiment.

FIG. 2 is a block diagram illustrating a characteristic functional configuration of refrigerator 200 according to the embodiment.

Refrigerator 200 is a storage unit capable of storing food and the like in at least one of a refrigeration temperature zone and a freezing temperature zone. Refrigerator 200 includes measurer 210, sensor 220, detector 230, transmitter 240, storage 250, and power supply 290. Refrigerator 200 also includes storage chamber 270 in which food and the like is stored, and door 280 which can be opened and closed in order to insert/remove food and the like to/from the inside of storage chamber 270 (also called the "interior"). Refrigerator 200 also includes a cooler for cooling the interior. The cooler may be a Peltier element or the like, but is compressor 260 in the present embodiment. Refrigerator 200 also includes power supply 290, which is electrically connected to devices in refrigerator 200, such as compressor 260, by power lines and the like, and which supplies power to those devices.

Measurer 210 measures the log information of refrigerator 200. As described above, the log information includes various types of information obtainable from refrigerator 200. Specifically, the log information includes temperature information indicating an interior temperature of refrigerator 200 and associated with times, and opened and closed information indicating a timing at which door 280 of refrigerator 200 has been opened and closed. In the present embodiment, the log information includes: (i) date/time information indicating a date/time at which measurer 210 obtained the log information; (ii) interior temperature information indicating the interior temperature, associated with the date/time; (iii) exterior temperature information indicating an exterior temperature (more specifically, an ambient temperature around refrigerator 200), associated with the date/time; (iv) storage amount information indicating a storage amount, associated with the date/time; (v) compressor operation information indicating an operation state of compressor 260, associated with the date/time; and (vi) the opened and closed information indicating an opened and closed state of door 280 (i.e., opened and closed information indicating a timing at which door 280 of refrigerator 200 has been opened and closed), associated with the date/time).

Note that the log information may include malfunction sensing result information indicating a malfunction status of refrigerator 200, associated with the date/time, and power supply information indicating a power status of refrigerator 200, associated with the date/time. For example, the log information may include malfunction information indicating at least one of an indication that a malfunction of refrigerator 200 has been sensed or an indication that no power is being supplied to refrigerator 200.

In the present embodiment, sensor 220 senses the malfunction status of refrigerator 200 and a power supply status to refrigerator 200.

In the following descriptions, a result of sensor 220 sensing the malfunction status of refrigerator 200 and the power supply status to refrigerator 200 may also be referred to as the log information.

Measurer 210 includes rotational frequency measurer 211, storage amount measurer 212, door open/closed measurer 213, interior temperature measurer 214, and exterior temperature measurer 215.

Rotational frequency measurer 211 measures a rotational frequency of a rotor of compressor 260, which is a cooler for cooling storage chamber 270, and more specifically, for compressing a coolant for cooling the interior. Rotational frequency measurer 211 includes, for example, a sensor that measures the rotational frequency of the rotor of compressor 260 each unit of time (e.g., 1 second). Rotational frequency measurer 211 outputs data indicating the measured rotational frequency per unit of time to malfunction sensor 221 and detector 230 as the compressor operation information indicating the operation state of compressor 260.

Note that the compressor operation information need not be the rotational frequency of the rotor per unit of time. For example, the compressor operation information may be information indicating a frequency at which the rotor is rotated, information indicating a rotational speed of the rotor, or the like. In this case, refrigerator 200 may include a sensor for measuring the information indicating the frequency at which the rotor is rotated, the rotational speed of the rotor, or the like.

Storage amount measurer 212 measures an amount of items (e.g., food items) stored in the interior. Storage amount measurer 212 includes, for example, a light source such as an LED (Light Emitting Diode) and a photodetector that detects light. Storage amount measurer 212 is, for example, disposed in the interior, and measures a storage amount in the interior on the basis of a ratio of an amount of light detected by the photodetector to an amount of light emitted by the light source. For example, based on the stated ratio, storage amount measurer 212 classifies the storage amount into a predetermined stage (e.g., five stages, on a scale of 1 to 5), and outputs data indicating a result of the classification to detector 230.

Door open/closed measurer 213 senses whether or not door 280 has been opened and closed. Door open/closed measurer 213 includes a piezoelectric sensor, for example.

Door open/closed measurer 213 outputs data indicating whether or not door 280 has been opened and closed (the opened and closed information) to detector 230. In the present embodiment, door open/closed measurer 213 outputs "1" to detector 230 when door 280 is open, and outputs "0" to detector 230 when door 280 is closed.

Interior temperature measurer 214 measures the interior temperature. Interior temperature measurer 214 includes, for example, a thermometer for measuring the interior temperature. Interior temperature measurer 214 outputs data indicating the measured interior temperature (the interior temperature information) to detector 230.

Exterior temperature measurer 215 measures an exterior temperature, and to be more specific, the ambient temperature outside a housing (not shown) of refrigerator 200 (i.e., the temperature of the space in which refrigerator 200 is installed). Exterior temperature measurer 215 includes, for example, a thermometer for measuring the exterior temperature. Exterior temperature measurer 215 outputs data indicating the measured exterior temperature (the exterior temperature information) to detector 230. Preferably, exterior temperature measurer 215 is provided on a front side of refrigerator 200. In other words, exterior temperature measurer 215 may be provided in a lower part of the door in refrigerator 200 is exposed on the outside of refrigerator 200, in a handle on the door, or the like. Providing exterior temperature measurer 215 (and more specifically, a part of the thermometer in exterior temperature measurer 215 that measures the temperature) on the front side of refrigerator 200 (and more specifically, on the side of refrigerator 200 on which the door is provided) makes exterior temperature measurer 215 less susceptible to the effects of compressor 260 than when provided on a rear side of refrigerator 200. Accordingly, by providing exterior temperature measurer 215 on the front side of refrigerator 200, the exterior temperature can be measured more accurately than when exterior temperature measurer 215 is provided on the rear side of refrigerator 200.

Sensor 220 is a processor that senses the malfunction status of refrigerator 200 and the power supply status to refrigerator 200. Specifically, sensor 220 senses at least one of a malfunction of refrigerator 200 or no power being supplied to refrigerator 200 (i.e., when the supply of power is stopped). In other words, sensor 220 senses whether or not refrigerator 200 has lost its cooling function. Sensor 220 includes, for example, malfunction sensor 221 and power sensor 222.

Malfunction sensor 221 is a processor that determines whether or not a cooling mechanism of refrigerator 200 is malfunctioning based on the compressor operation information received from rotational frequency measurer 211. Specifically, malfunction sensor 221 determines whether or not compressor 260 is malfunctioning on the basis of the compressor operation information.

For example, refrigerator 200 includes a controller (not shown) serving as a processor that controls various devices included in refrigerator 200, such as compressor 260. This controller outputs a control signal indicating a rotational frequency of compressor 260 to compressor 260, for example. Compressor 260 rotates at a rotational frequency determined based on the control signal. Malfunction sensor 221 receives the control signal for controlling compressor 260 from the controller, for example. When, on the basis of the control signal, the controller is executing control for causing compressor 260 to rotate, i.e., is outputting the control signal to compressor 260, malfunction sensor 221 obtains the compressor operation information including the rotational frequency of compressor 260, and determines whether or not compressor 260 is rotating at the same rotational frequency as that indicated by the control signal based on the obtained compressor operation information to determine whether or not compressor 260 is malfunctioning. When, for example, compressor 260 is rotating at the same rotational frequency as that indicated by the control signal, malfunction sensor 221 determines that compressor 260 is operating normally, i.e., is not malfunctioning, whereas when compressor 260 is not rotating at the same rotational frequency as that indicated by the control signal, malfunction sensor 221 determines that compressor 260, i.e., refrigerator 200, is malfunctioning.

Malfunction sensor 221 is realized, for example, by a control program stored in storage 250 or the like and a CPU (Central Processing Unit) that executes the control program. Malfunction sensor 221 may be realized by dedicated circuitry or the like, for example.

Power sensor 222 senses whether or not power is being supplied to the various devices of refrigerator 200, such as compressor 260. Power sensor 222 includes at least one of an ammeter or a voltmeter, for example. Power sensor 222 senses whether or not power is being supplied to the various devices of refrigerator 200 from power supply 290, for example.

Sensor 220 outputs, to detector 230, information indicating sensing results sensed by malfunction sensor 221 and power sensor 222. For example, in at least one of a case where malfunction sensor 221 has sensed a malfunction of refrigerator 200 or a case where power sensor 222 has sensed that no power is being supplied to refrigerator 200, sensor 220 outputs, to detector 230, information indicating at least one of an indication that a malfunction of refrigerator 200 has been sensed or an indication that no power is being supplied to refrigerator 200, as the malfunction information.

Detector 230 is a processor that detects (i.e., obtains) the log information, which includes the temperature information indicating the interior temperature of refrigerator 200, the opened and closed information indicating whether or not door 280 of refrigerator 200 has been opened and closed, the malfunction sensing result information indicating the malfunction status of refrigerator 200, and the like, measured or sensed by measurer 210 or sensor 220. Specifically, detector 230 detects the log information output from the various units of measurer 210. Detector 230 sends the detected log information to refrigerator management device 300 via transmitter 240.

Detector 230 is realized, for example, by a control program stored in storage 250 or the like and a CPU (Central Processing Unit) that executes the control program. Detector 230 may be realized by dedicated circuitry or the like, for example.

Note that detector 230 may store the detected log information in storage 250. Detector 230 may send the log information stored in storage 250 to refrigerator management device 300 via transmitter 240 at a predetermined timing.

Transmitter 240 is a communication interface for sending the log information detected by detector 230 to refrigerator management device 300. For example, when wireless communication is used, transmitter 240 is realized by a wireless communication circuit, whereas when wired communication is used, transmitter 240 is realized by a connector that can be connected to a communication line. Detector 230 sends the detected log information to refrigerator management device 300 via transmitter 240, for example.

Note that detector 230 may send all the log information at once, or may send only some of the log information, via transmitter 240. For example, detector 230 may send the temperature information and the opened and closed information included in the log information together, or may send each of these separately, i.e., at separate times, via transmitter 240.

Storage 250 is a storage device that stores control programs executed by detector 230 or the like, the log information, or the like. Storage 250 is realized by an HDD (Hard Disk Drive), Flash memory, or the like, for example.

Compressor 260 is a cooler for cooling the interior. Specifically, compressor 260 is a compressor that pressure-feeds a coolant, such as a gas, using rotational motion of an impeller or rotor or reciprocal motion of a piston.

Storage chamber 270 is a storage chamber for storing items such as food items. In the present embodiment, storage chamber 270 may be a freezer compartment, a refrigerator compartment, or a vegetable crisper. In other words, the interior temperature cooled by compressor 260 can be set as desired.

Door 280 is a door for opening and closing storage chamber 270.

Power supply 290 is a power supply circuit that converts AC power from an external commercial power supply (not shown) into DC current at a predetermined level by rectification, smoothing, stepping down, and the like of the power, and supplies the converted power to the various devices of refrigerator 200.

Note that in the log information measured or detected by the units in measurer 210 and output to detector 230, date/time information indicating a date/time at which each unit measured or detected the information may be associated with each unit, and detector 230 may associate the date/time information with the log information at the timing at which the log information is received.

Refrigerator 200 may also include a time measurer such as a RTC (Real Time Clock) for measuring the date/time.

Refrigerator Management Device

FIG. 3 is a block diagram illustrating a characteristic functional configuration of refrigerator management device 300 according to the embodiment.

Refrigerator management device 300 is a device that calculates a timewise change in the interior temperature of refrigerator 200 based on the log information received from refrigerator 200. Specifically, refrigerator management device 300 is a device that, based on the log information, calculates a timewise change in the interior temperature of refrigerator 200 for when the cooling function of the refrigerator is stopped, and notifies the user of a calculation result by sending result information indicating the calculation result to terminal device 400.

Refrigerator management device 300 is, for example, a personal computer. In the present embodiment, refrigerator management device 300 is a server device.

Refrigerator management device 300 includes communicator 310, storage 320, obtainer 330, calculator 340, outputter 350, and controller 360.

Communicator 310 is a communication interface for communicating with refrigerator 200 and terminal device 400. For example, when wireless communication is used, communicator 310 is realized by a wireless communication circuit, whereas when wired communication is used, communicator 310 is realized by a connector that can be connected to a communication line. Communicator 310 receives the log information detected by refrigerator 200.

Storage 320 is a storage device that stores the log information received via communicator 310. Storage 320 is realized by an HDD, Flash memory, or the like, for example.

Obtainer 330 is a processor that obtains the log information, including the temperature information indicating the interior temperature of refrigerator 200, the opened and closed information indicating whether or not door 280 or refrigerator 200 has been opened and closed, and the like. Specifically, obtainer 330 obtains the log information, including the temperature information indicating the interior temperature of refrigerator 200 including compressor 260, the compressor operation information indicating the operation state of compressor 260, and the opened and closed information indicating whether or not door 280 of refrigerator 200 has been opened and closed. Obtainer 330 obtains the log information stored in storage 320, for example. Alternatively, obtainer 330 obtains the log information sent from refrigerator 200 via communicator 310, for example.

More specifically, when, for example, controller 360 has received instruction information for calculating the timewise change in the interior temperature from terminal device 400 via communicator 310, obtainer 330 obtains the log information stored in storage 320.

Additionally, obtainer 330 obtains, via communicator 310, the malfunction information, indicating at least one of an indication that a malfunction of refrigerator 200 has been sensed or an indication of a stop in the supply of power to refrigerator 200, sensed by sensor 220 and sent from refrigerator 200, for example.

Obtainer 330 obtains the malfunction result information included in the log information stored in storage 320, for example. Based on the obtained malfunction result information, obtainer 330 determines whether or not sensor 220 has sensed a malfunction of refrigerator 200. When it is determined that sensor 220 has sensed a malfunction of refrigerator 200, obtainer 330 obtains the malfunction result information as the malfunction information indicating that a malfunction of refrigerator 200 has been sensed, for example.

Alternatively, obtainer 330 obtains the power supply information included in the log information stored in storage 320, for example. Based on the obtained power supply information, obtainer 330 determines whether or not sensor 220 has sensed a stop in the supply of power to refrigerator 200. When it is determined that sensor 220 has sensed a stop in the supply of power to refrigerator 200, obtainer 330 obtains the power supply information as the malfunction information indicating that the supply of power to refrigerator 200 has stopped, for example.

Calculator 340 is a processor that, based on the log information obtained by obtainer 330, calculates a timewise change in the interior temperature for when door 280 is opened and closed in a predetermined period and when door 280 is not opened and closed in the predetermined period. Calculator 340 starts the stated calculation when, for example, obtainer 330 has obtained the malfunction information. Specifically, calculator 340 calculates a timewise change in the interior temperature based on a change in the temperature information when the compressor operation information included in the log information indicates a stopped state of compressor 260.

More specifically, based on the log information, calculator 340 calculates a timewise change in the interior temperature of refrigerator 200 for when door 280 is opened and closed and when door 280 is not opened and closed in a case where compressor 260 is stopped. Here, compressor 260 being stopped refers to a case where compressor 260 is not operating, such as when the rotational frequency of compressor 260 is 0, the rotational speed of compressor 260 is 0, or the like.

Outputter 350 is a processor that outputs a calculation result calculated by calculator 340 (more specifically, data indicating the calculation result (result information)). Specifically, outputter 350 sends the result information to terminal device 400 via communicator 310. The result information may be any information that can notify the user of the calculation result from calculator 340, such as image data, audio data, lighting information indicating a lighting state such as flashing a light source, or the like. The result information is image data in the present embodiment.

Outputter 350 outputs the result information, for example, after sensor 220 has sensed at least one of a malfunction of refrigerator 200 or a stop in the supply of power to refrigerator 200, and more specifically, after obtainer 330 has obtained the malfunction information. In other words, calculator 340 calculates a timewise change in the interior temperature for when door 280 of refrigerator 200 is not opened and closed and when door 280 is opened and closed, after obtainer 330 has obtained the malfunction information, for example. Outputter 350 outputs the calculation result calculated by calculator 340 (information indicating the calculation result) in this manner.

Additionally, for example, obtainer 330 obtains timing information indicating an expected timing at which door 280 is expected to be opened and closed. In this case, calculator 340 calculates a timewise change in the interior temperature for when door 280 is opened and closed at the timing indicated by the timing information obtained by obtainer 330, for example. Obtainer 330 may obtain the timing information stored in storage 320 or the like in advance, or may obtain the timing information sent from terminal device 400 or the like via communicator 310.

Additionally, for example, calculator 340 may determine whether or not the interior temperature will exceed a predetermined temperature at a predetermined time on the basis of the calculated timewise change in the interior temperature. In this case, outputter 350 may output a determination result by calculator 340 (more specifically, determination result information indicating the determination result) as the calculation result from calculator 340. Note that information indicating the predetermined time and the predetermined temperature may each be stored in storage 320 or the like in advance, or may be sent from terminal device 400 or the like to refrigerator management device 300. For example, obtainer 330 obtains time information indicating the predetermined time from storage 320 or from terminal device 400 via communicator 310.

Additionally, for example, based on the calculated timewise change in the interior temperature, calculator 340 calculates (estimates) a maximum length of time from when at least one of a malfunction of refrigerator 200 or a stop in the supply of power to refrigerator 200 is sensed by sensor 220, and more specifically, from when obtainer 330 obtains the malfunction information, to when the interior temperature exceeds a predetermined temperature. In this case, outputter 350 may output the maximum length of time estimated by calculator 340 (maximum length of time information indicating the maximum length of time) as the calculation result (an estimation result) from calculator 340.

Outputter 350 outputs the calculation result calculated by calculator 340 as described above, as well as the malfunction information indicating at least one of an indication that a malfunction of refrigerator 200 has been sensed or an indication that no power is being supplied to refrigerator 200, to terminal device 400 via communicator 310, for example.

Controller 360 is a processor that executes various types of processing for refrigerator management device 300. Controller 360 receives the log information from refrigerator 200 via communicator 310 and stores the received log information in storage 320, for example.

Obtainer 330, calculator 340, outputter 350, and controller 360 are realized, for example, by a control program stored in storage 320 or the like and a CPU (Central Processing Unit) that executes the control program. Obtainer 330, calculator 340, outputter 350, and controller 360 may be realized by dedicated circuitry or the like, for example.

Note that date/time information is not associated with the log information measured or detected by the various units of measurer 210 and output to detector 230, and date/time information indicating the date/time at which each unit performed measurement or detection may be associated by refrigerator management device 300.

Refrigerator management device 300 may also include a time measurer such as a RTC (Real Time Clock) for measuring the date/time.

Terminal Device

FIG. 4 is a block diagram illustrating a characteristic functional configuration of terminal device 400 according to the embodiment.

Terminal device 400 is a device that notifies the user of the calculation result from calculator 340 based on the result information output from outputter 350 of refrigerator management device 300. Terminal device 400 is, for example, a smartphone, a tablet terminal, a personal computer, or the like.

Terminal device 400 includes communicator 410, inputter 420, controller 430, notifier 440, and storage 450.

Communicator 410 is a communication interface for communicating with refrigerator 200 and refrigerator management device 300. For example, when wireless communication is used, communicator 410 is realized by a wireless communication circuit, whereas when wired communication is used, communicator 410 is realized by a connector that can be connected to a communication line. Communicator 410 receives the result information sent from refrigerator management device 300.

Inputter 420 is a device that accepts inputs from the user. Inputter 420 is realized by buttons, a touch panel, or the like, for example.

Controller 430 is a processor that executes various types of processing executed by terminal device 400. For example, controller 430 notifies user of the calculation result by controlling notifier 440 based on the result information received from refrigerator management device 300 via communicator 410.

Controller 430 is realized, for example, by a control program stored in storage 450 or the like and a CPU that executes the control program. Controller 430 may be realized by dedicated circuitry or the like, for example.

Notifier 440 is a device for notifying the user of the calculation result from calculator 340. When the result information is image data, notifier 440 is realized by a display such as a liquid crystal display or an organic EL (Electro Luminescence) display that displays an image based on the image data; when the result information is audio data, notifier 440 is realized by an audio emitter such as an amp, a speaker, and the like; and when the result information is lighting information, notifier 440 is realized by a light source. In the present embodiment, notifier 440 is a display that displays an image. More specifically, in the present embodiment, touch panel display 460 (see FIG. 8, for example) is used, in which inputter 420 and notifier 440 are formed in an integrated manner.

Storage 450 is a storage device that stores control programs executed by controller 430. Storage 450 is realized by an HDD, Flash memory, or the like, for example.

Log Information and Result Information

An example of the log information detected by refrigerator 200 and an example of the calculation result calculated by refrigerator management device 300 will be described next with reference to FIGS. 5 to 7.

FIG. 5 is a table illustrating an example of log information detected by refrigerator 200 according to the embodiment.

As illustrated in FIG. 5, the log information includes, for example: the date/time information indicating the date/time; interior temperature information indicating the interior temperature; the exterior temperature information indicating the exterior temperature; the storage amount information indicating the storage amount in the interior; the malfunction sensing result information indicating whether or not compressor 260 is malfunctioning; the compressor operation information indicating the rotational frequency of compressor 260; the opened and closed information indicating whether door 280 is opened or closed; and the power supply information indicating whether power is being supplied to refrigerator 200.

Note that the interior temperature information, the exterior temperature information, the storage amount information, the compressor operation information, and the opened and closed information are examples of measurement results from measurer 210. The malfunction sensing result information and the power supply information are examples of the sensing result from sensor 220.

The malfunction sensing result information is an example of the malfunction information indicating that a malfunction of refrigerator 200 has been sensed when malfunction sensor 221 has sensed a malfunction of refrigerator 200. The power supply information is an example of the malfunction information indicating that no power is being supplied to refrigerator 200 when power sensor 222 has sensed that no power is being supplied to refrigerator 200.

Measurer 210 and sensor 220 measure or sense this information at a predetermined timing, and output the measurement or sensing result to detector 230, for example. In the present embodiment, measurer 210 and sensor 220 measure or sense the information every five seconds.

Figure 6:
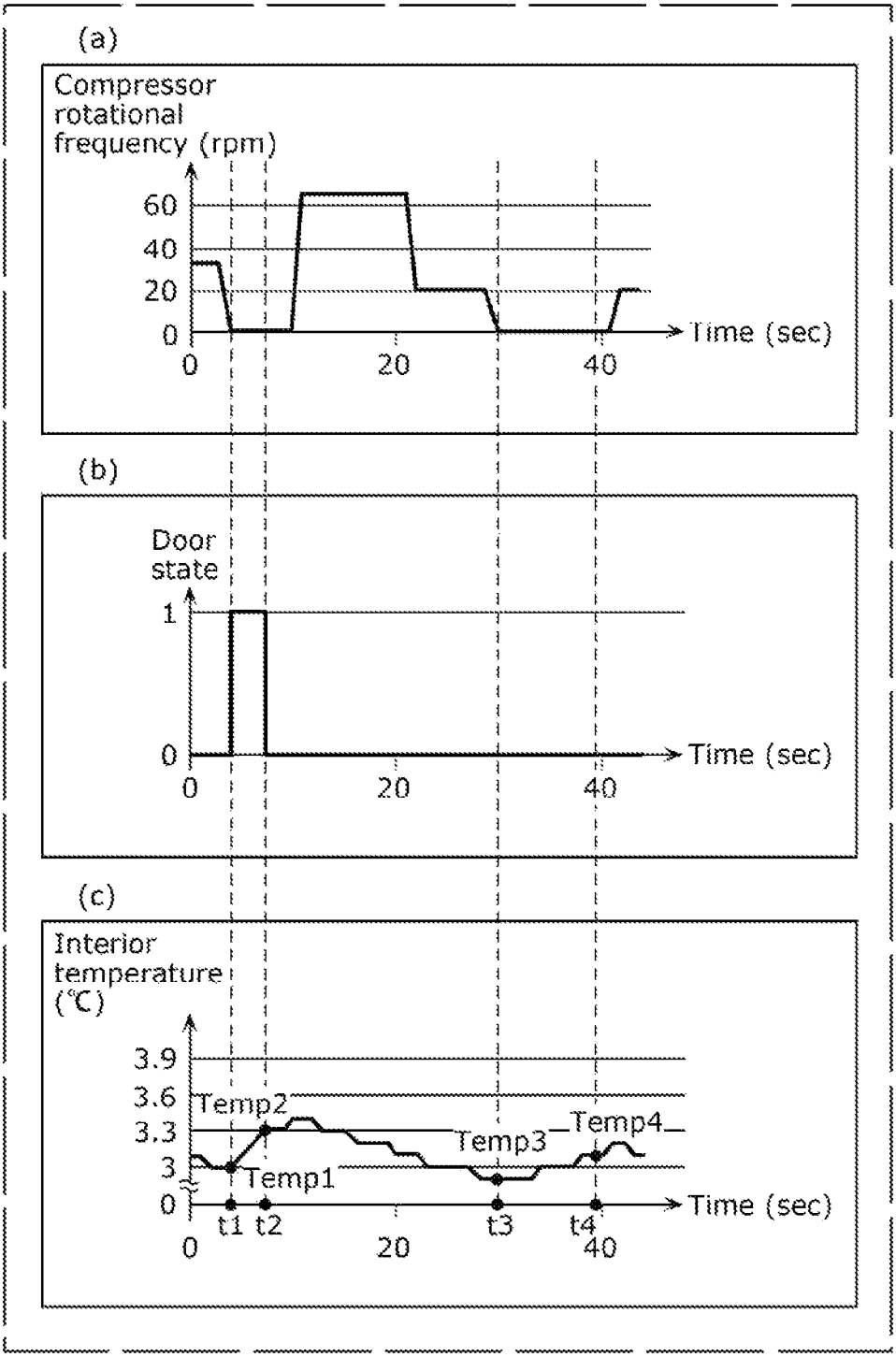
FIG. 6 is graphs illustrating an example of log information detected by the refrigerator according to the embodiment.

FIG. 6 is graphs illustrating an example of the log information detected by refrigerator 200 according to the embodiment. Specifically, FIG. 6 is graphs illustrating an example of timewise changes in the various types of log information.

Note that the horizontal axes in FIG. 6 represent time (in seconds (sec)), whereas the vertical axes represent the rotational frequency of compressor 260 (in rpms (rotations per minute) in (a) of FIG. 6, the opened and closed state of door 280 (an opened state or a closed state) in (b) of FIG. 6, and the interior temperature (in ° C.) in (c) of FIG. 6. In (b) of FIG. 6, 1 indicates the opened state, i.e., that door 280 is open, and 0 indicates the closed state, i.e., that the door is closed. In (a) to (c) of FIG. 6, the time is the same timing for each, with the measurement starting point set to 0 and the time elapsed from that point being indicated. In the state illustrated in FIG. 6, it is assumed that refrigerator 200 (and more specifically, compressor 260) is not malfunctioning.

As illustrated in FIG. 6, at time t1, for example, the rotational frequency of compressor 260 is 0. Compressor 260 rotates and stops rotating to keep the interior temperature at the predetermined temperature.

Additionally, assume that door 280 is in the opened state in a period from time t1 to time t2. Calculator 340 calculates the timewise change in the interior temperature when door 280 is in the opened state, based on the timewise change in the interior temperature from time t1 to time t2.

For example, when the interior temperature at time t1 is represented by Temp1 and the interior temperature at time t2 is represented by Temp2, coefficient kA for calculating the timewise change in the interior temperature can be expressed by the following Equation (1).

$$kA = \frac{Temp2 - Temp1}{t2 - t1} \quad \text{Equation (1)}$$

Additionally, at time t3, for example, the rotational frequency of compressor 260 is 0.

Additionally, assume that door 280 is in the closed state in a period from time t3 to time t4. Calculator 340 calculates the timewise change in the interior temperature when door 280 is in the closed state, based on the timewise change in the interior temperature from time t3 to time t4.

For example, when the interior temperature at time t3 is represented by Temp3 and the interior temperature at time t4 is represented by Temp4, coefficient kB for calculating the timewise change in the interior temperature can be expressed by the following Equation (2).

$$kB = \frac{Temp4 - Temp3}{t4 - t3} \quad \text{Equation (2)}$$

As described above, assuming that the timewise change in the interior temperature is constant, for example, calculator 340 can calculate coefficients kA and kB for calculating the timewise change in the interior temperature based on the foregoing Equations (1) and (2). Calculator 340 calculates the interior temperature at the predetermined time based on coefficients kA and kB calculated in this manner, for example.

Figure 7:
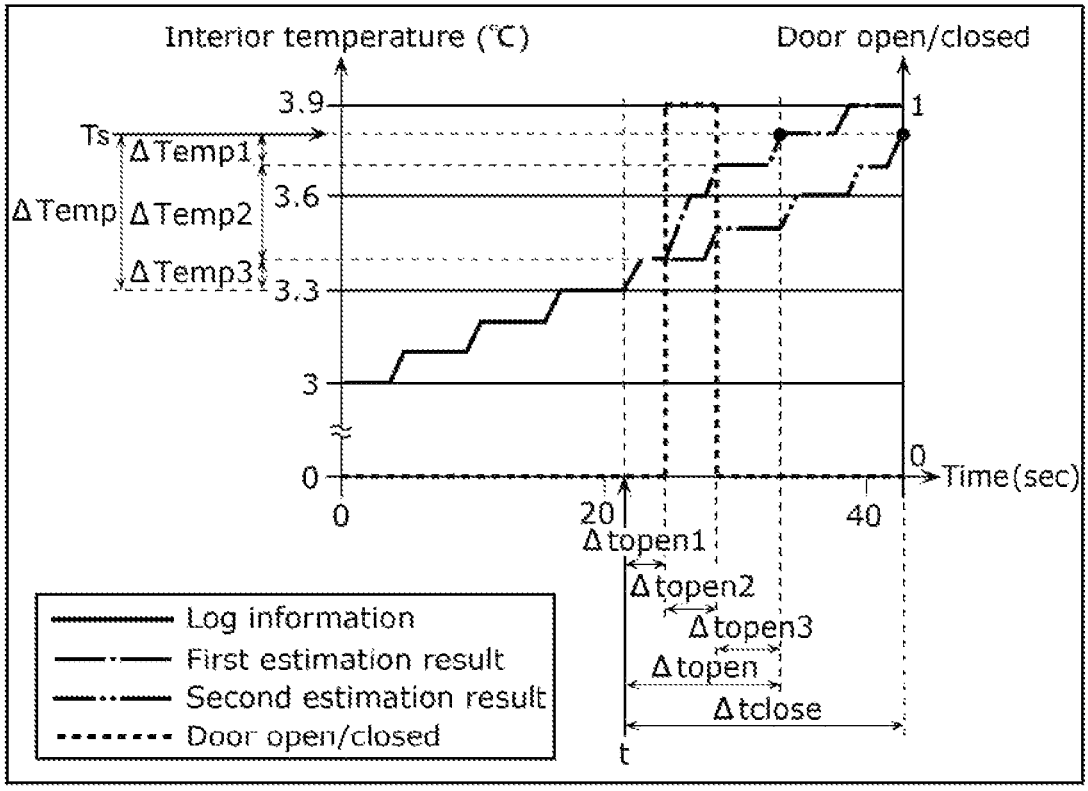
FIG. 7 is a graph illustrating an example of calculated values of a change in interior temperature calculated by the refrigerator management device according to the embodiment.

FIG. 7 is a diagram illustrating an example of calculated values of a change in interior temperature calculated by refrigerator management device 300 according to the embodiment. In FIG. 7, it is assumed that compressor 260 has malfunctioned and refrigerator 200 has lost its cooling function at time t, for example.

Calculator 340 calculates, for example, the time it takes for the interior temperature to rise from the temperature at time t (3.3° C., in the present embodiment) to predetermined temperature Ts. Specifically, calculator 340 calculates, for example, a time it takes for the interior temperature to rise from the temperature at time t to predetermined temperature Ts, for when door 280 is opened and closed (Atopen) and for when door 280 is not opened and closed (Atclose). Note that Atopen represents the time it takes for the interior temperature to reach predetermined temperature Ts when door 280 has been opened even once. In the present embodiment, door 280 is closed in Δtopen1 and Δtopen3, and door 280 is opened in Δtopen2.

Assuming, for example, that the timewise changes in the interior temperature in Δtopen1, Δtopen2, and Δtopen3 are ΔTemp1, ΔTemp2, and ΔTemp3, respectively, calculator 340 calculates Δtopen and Δtclose through the following Equations (3) and (4).

$$\Delta topen = \frac{\Delta Temp1}{kB} + \frac{\Delta Temp2}{kA} + \frac{\Delta Temp3}{kB} \quad \text{Equation (3)}$$

$$\Delta tclose = \frac{\Delta Temp}{kB} \quad \text{Equation (4)}$$

Through this, calculator 340 can calculate the timewise change in the interior temperature for when door 280 is open, and more specifically, for when door 280 is opened and closed, as well as the timewise change in the interior temperature for when door 280 is not opened and closed, and more specifically, for when door 280 remains closed.

Refrigerator management device 300 sends result information indicating the calculation results calculated in this manner to terminal device 400.

Note that calculator 340 may use timewise changes indicated by the log information as-is, rather than using the foregoing Equations (1) and (2), for the timewise change in the interior temperature when door 280 is in an opened state and the timewise change in the interior temperature when door 280 is in a closed state.

Display Example

An example of an image displayed in terminal device 400 will be described next with reference to FIG. 8.

Figure 8:
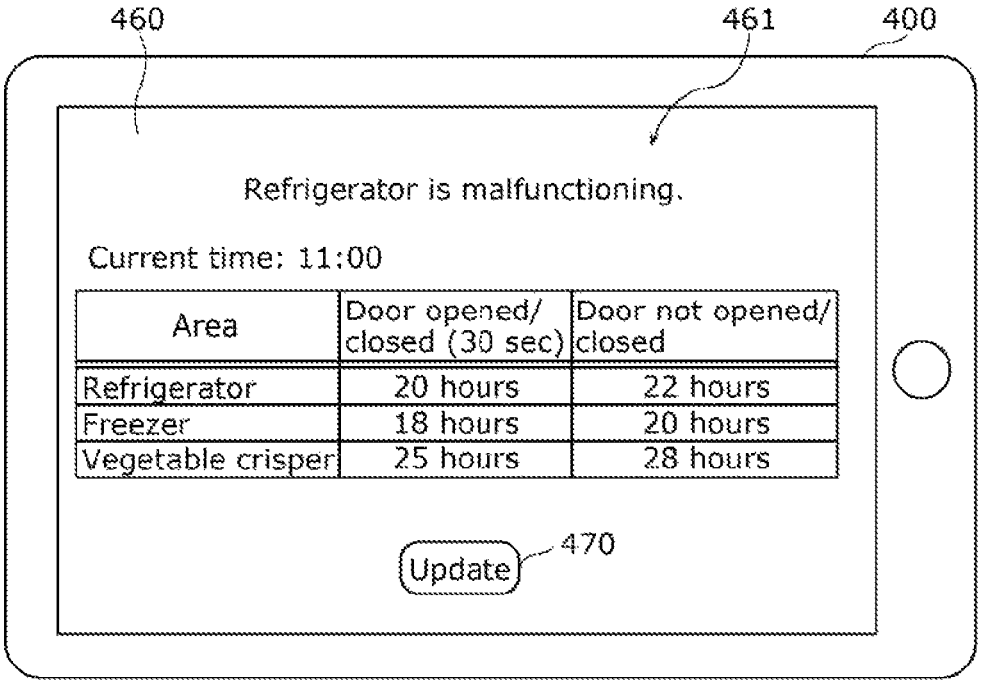
FIG. 8 is a diagram illustrating an example of an image, displayed in the terminal device, indicating a result of calculating the interior temperature of the refrigerator, according to the embodiment.

FIG. 8 is a diagram illustrating an example of an image, displayed in terminal device 400, indicating a result of calculating the interior temperature of refrigerator 200, according to the embodiment.

For example, when the result information has been received via communicator 410, controller 430 causes touch panel display 460 to display image 461, indicating the calculation result from refrigerator management device 300, based on the result information.

Image 461 includes, for example, information indicating the current time, as well as the time it will take for the interior temperature to reach the predetermined temperature from the current time, for each of the refrigerator compartment, the freezer compartment, and the vegetable crisper, which are specific examples of storage chamber 270 provided in refrigerator 200. More specifically, image 461 includes information indicating the time it will take for each interior temperature to reach the predetermined temperature from the current time when door 280 is opened for 30 seconds, and the time it will take for each interior temperature to reach the predetermined temperature from the current time when door 280 remains closed, for each of the refrigerator compartment, the freezer compartment, and the vegetable crisper, for example.

Through this, the user can easily understand the interior temperature.

Additionally, image 461 may include an image for accepting an input from the user, for example. For example, image 461 includes acceptance part 470, which is an image indicating a button such as "update". When, for example, the user presses acceptance part 470, controller 430 may send, to refrigerator management device 300, update request information requesting the information indicating the time it will take for each interior temperature to reach the predetermined temperature from the current time when door 280 is opened for 30 seconds, and the time it will take for each interior temperature to reach the predetermined temperature from the current time when door 280 remains closed, according to the current time. Upon receiving the update request information, refrigerator management device 300 may recalculate the time it will take for each interior temperature to reach the predetermined temperature from the current time when door 280 is opened for 30 seconds, and the time it will take for each interior temperature to reach the predetermined temperature from the current time when door 280 remains closed, and may send result information indicating the calculation result to terminal device 400. Terminal device 400 may update (change) the image displayed in touch panel display 460 based on the result information.

Processing Sequence

A processing sequence of processing executed by refrigerator management system 100 will be described next with reference to FIGS. 9 and 10.

Figure 9:
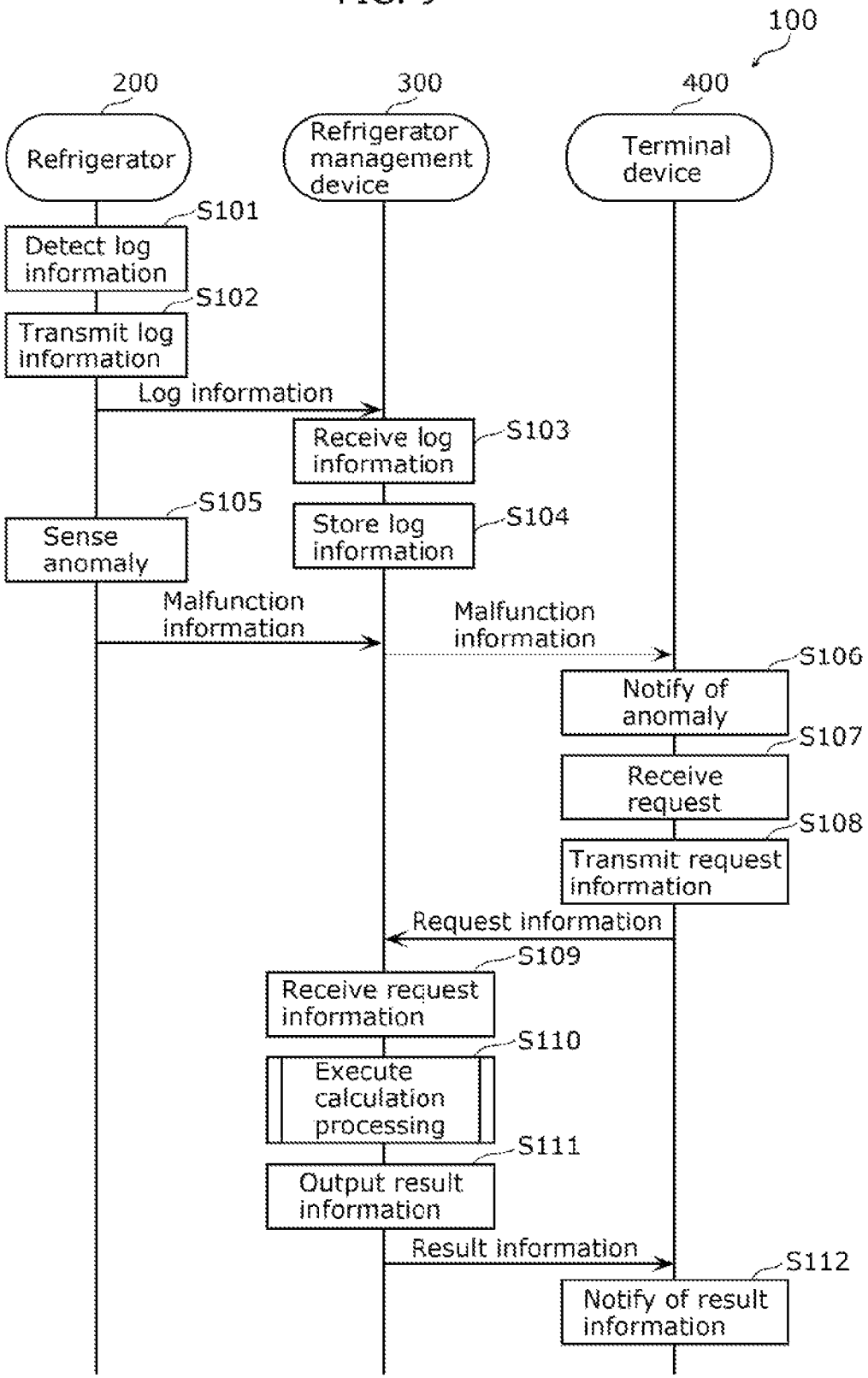
FIG. 9 is a sequence chart illustrating a processing sequence executed by the refrigerator management system according to the embodiment.

FIG. 9 is a sequence chart illustrating the processing sequence executed by refrigerator management system 100 according to the embodiment.

First, refrigerator 200 detects the log information (step S101). Refrigerator 200 repeatedly executes step S101 at predetermined intervals of time.

Next, refrigerator 200 sends the log information detected in step S101 to refrigerator management device 300 (step S102). Note that refrigerator 200 may execute step S102 each time step S101 is executed, or may store the log information detected in step S101 in storage 250, and may then send a plurality of instances of stored log information together.

Next, refrigerator management device 300 receives the log information (step S103).

Next, refrigerator management device 300 stores the log information received in step S103 (step S104). Refrigerator 200 and refrigerator management device 300 repeatedly execute step S101 to step S104.

Here, assume that refrigerator 200 has sensed an anomaly in the cooling function (step S105). Step S105 corresponds to a case where, for example, malfunction sensor 221 has sensed a malfunction of compressor 260, or power sensor 222 has detected that no power is being supplied to the various units from power supply 290.

Next, refrigerator 200 sends the malfunction information to refrigerator management device 300. Refrigerator management device 300 also sends the received malfunction information to terminal device 400.

Note that when refrigerator 200 and terminal device 400 are capable of communicating with each other directly, refrigerator 200 may send the malfunction information directly to terminal device 400. In this case, when, for example, the sensing result from sensor 220 is at least one of an indication that a malfunction of refrigerator 200 has been sensed or an indication that no power is being supplied to refrigerator 200, detector 230 may send the malfunction information to terminal device 400 via transmitter 240.

When the malfunction information has been received, terminal device 400 notifies the user of information indicating that an anomaly has occurred in the cooling function of refrigerator 200, for example (step S106). In step S106, for example, terminal device 400 displays an image including the information of image 461 illustrated in FIG. 8, aside from the time taken until the predetermined temperature is reached.

Next, assume, for example, that terminal device 400 has received a request requesting the calculation result for the timewise change in the interior temperature from the user (step S107). Assume, for example, that in step S107, acceptance part 470 has been pressed in terminal device 400. Additionally, in step S107, the timing information indicating the expected timing at which door 280 is expected to be opened and closed is accepted from the user through acceptance part 470, for example.

Terminal device 400 then sends, to refrigerator management device 300, request information indicating that the request requesting the calculation result for the timewise change in the interior temperature has been accepted from the user (step S108). If acceptance part 470 has accepted the timing information in step S107, terminal device 400 also sends the timing information.

Refrigerator management device 300 then receives the request information (step S109).

Next, refrigerator management device 300 executes the calculation processing that, based on the log information, calculates a timewise change in the interior temperature for when door 280 is opened and closed in a predetermined period and when door 280 is not opened and closed in the predetermined period (step S110).

Next, refrigerator management device 300 outputs the result information indicating the calculation result of the calculation performed in step S110 (and more specifically, sends the result information to terminal device 400) (step S111).

Terminal device 400 notifies the user of the received result information (displays the information, in the present embodiment) (step S112).

Figure 10:
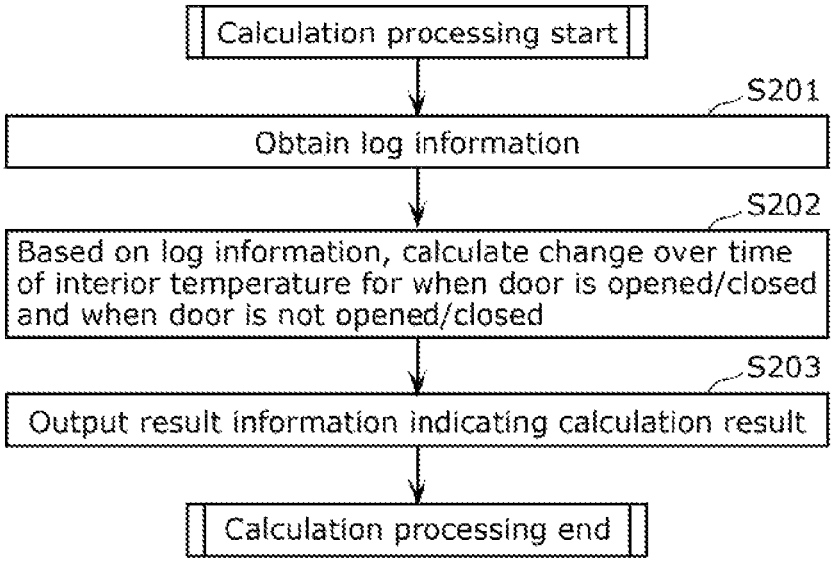
FIG. 10 is a flowchart illustrating a processing sequence for calculation processing executed by the refrigerator management device according to the embodiment.

FIG. 10 is a flowchart illustrating a processing sequence for calculation processing executed by refrigerator management device 300 according to the embodiment. More specifically, FIG. 10 is a flowchart illustrating step S110 of FIG. 9 in detail.

First, obtainer 330 of refrigerator management device 300 obtains the log information stored in storage 320 (step S201).

Next, based on the log information obtained by obtainer 330 in step S201, calculator 340 of refrigerator management device 300 calculates the timewise change in the interior temperature for when door 280 of refrigerator 200 has been opened and closed and the timewise change in the interior temperature for when door 280 of refrigerator 200 has not been opened and closed (step S202).

Next, refrigerator management device 300 outputs the result information indicating the calculation result of the calculation performed in step S202 (step S203). To be more specific, refrigerator management device 300 sends the result information indicating the calculation result of the calculation performed in step S203 to terminal device 400.

Note that the timing at which each step in FIG. 10 is executed may be set as desired. For example, refrigerator management device 300 may repeatedly execute the steps in FIG. 10 at predetermined timings, or may execute the steps when detected information is received.

Additionally, in step S202, calculator 340 may calculate the time it takes for the interior temperature to reach the predetermined temperature. The predetermined temperature may be stored in storage 320 in advance, or may be included in request notification information.

Additionally, after step S202, calculator 340 may further determine whether or not the interior temperature has exceeded the predetermined temperature at the predetermined time based on the calculated timewise change in the interior temperature, and include the determination result (determination result information indicating the determination result) in the calculation result (the result information indicating the calculation result). When calculator 340 makes such a determination, terminal device 400 may, for example, accept the input of the time information indicating the predetermined time from the user in step S107, and send the accepted time information indicating the predetermined time in step S108. In this case, obtainer 330 obtains the time information received from terminal device 400 in step S201, for example.

Additionally, if obtainer 330 further obtains the malfunction information after step S202, based on the calculated timewise change in the interior temperature, calculator 340 may further estimate the maximum length of time from when at least one of a malfunction of refrigerator 200 or a stop in the supply of power to refrigerator 200 is sensed by sensor 220 to when the interior temperature exceeds the predetermined temperature. In this case, outputter 350 may include information indicating the maximum length of time estimated by calculator 340 (maximum length of time information) in the result information and output the result information.

In step S203, outputter 350 outputs the result information indicating at least one of the above-described calculation results from calculator 340.

Figure 11:
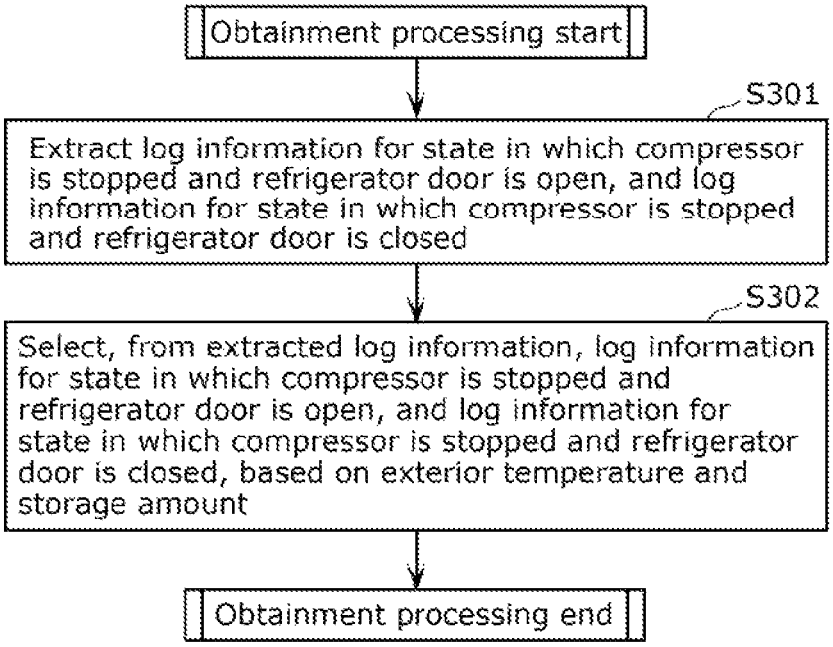
FIG. 11 is a flowchart illustrating a processing sequence for obtainment processing executed by the refrigerator management device according to the embodiment.

FIG. 11 is a flowchart illustrating a processing sequence for obtainment processing executed by refrigerator management device 300 according to the embodiment. More specifically, FIG. 11 is a flowchart illustrating step S201 of FIG. 10 in detail.

First, obtainer 330 of refrigerator management device 300 extracts, from the log information stored in storage 320, log information for a state where compressor 260 is in a stopped state (i.e., a state where the rotational frequency is 0) and door 280 of refrigerator 200 is in an opened state, and log information for a state where compressor 260 is stopped and door 280 of refrigerator 200 is in a closed state (step S301).

Next, based on the exterior temperature and the storage amount, obtainer 330 of refrigerator management device 300 selects and obtains, from the log information extracted in step S301, log information for a state where compressor 260 is stopped and door 280 of refrigerator 200 is in an opened state, and log information for a state where compressor 260 is stopped and door 280 of refrigerator 200 is in a closed state (step S302). For example, obtainer 330 obtains, from the newest log information, log information indicating the exterior temperature and the storage amount of refrigerator 200, and selects and obtains the log information, from the log information extracted in step S301, which matches or is the closest to the stated exterior temperature and storage amount.

Next, calculator 340 of refrigerator management device 300 executes step S202 of FIG. 10. Specifically, in step S202, based on the log information selected and obtained by obtainer 330 in step S302, calculator 340 calculates the timewise change in the interior temperature for when door 280 of refrigerator 200 has been opened and closed and the timewise change in the interior temperature for when door 280 of refrigerator 200 has not been opened and closed.

Note that when compressor 260 is malfunctioning and power supply 290 is operating normally, i.e., when power is being supplied to refrigerator 200 normally, the various sensors of refrigerator 200 operate normally. Accordingly, for example, if malfunction sensor 221 has sensed a malfunction of compressor 260 in step S105 of FIG. 9, refrigerator 200 may repeatedly execute step S101 and step S102. Of course, if malfunction sensor 221 has sensed a malfunction of compressor 260 in step S105 of FIG. 9, refrigerator 200 need not repeatedly execute step S101 and step S102.

Additionally, in FIG. 9, refrigerator management device 300 executes step S109 when the request information has been received, but the processing is not limited thereto. For example, refrigerator management device 300 may execute the processing of steps S110 and on when the malfunction information is received after step S105 in FIG. 9 has been executed by refrigerator 200.

Accordingly, by refrigerator management device 300 executing step S110 when the malfunction information has been received, the result information will already have been generated when the user operates terminal device 400 to cause terminal device 400 to send the request information (i.e., when terminal device 400 has executed step S108), and thus the result information can be sent to terminal device 400 immediately. Alternatively, by refrigerator management device 300 executing step S110 or step S111 when the malfunction information is received, the user can be notified in detail of the effect the anomaly in refrigerator 200 will have on the interior.

Additionally, in step S202 of FIG. 10, when, for example, the timing information is being obtained, based on the log information and the timing information obtained by obtainer 330 in step S201, calculator 340 of refrigerator management device 300 calculates the timewise change in the interior temperature for when door 280 of refrigerator 200 has been opened and closed and the timewise change in the interior temperature for when door 280 of refrigerator 200 has not been opened and closed, at the timing indicated by the stated timing information. Here, when refrigerator management device 300 immediately executes step S110 and step S111 upon receiving the malfunction information, the timewise change in the interior temperature for when door 280 of refrigerator 200 has been opened and closed, and the timewise change in the interior temperature for when door 280 of refrigerator 200 has not been opened and closed, may be calculated at any desired timing.

[Variations]

Next, variations on the image displayed in terminal device 400 will be described with reference to FIGS. 12 to 14.

[Variation 1]

Figure 12:
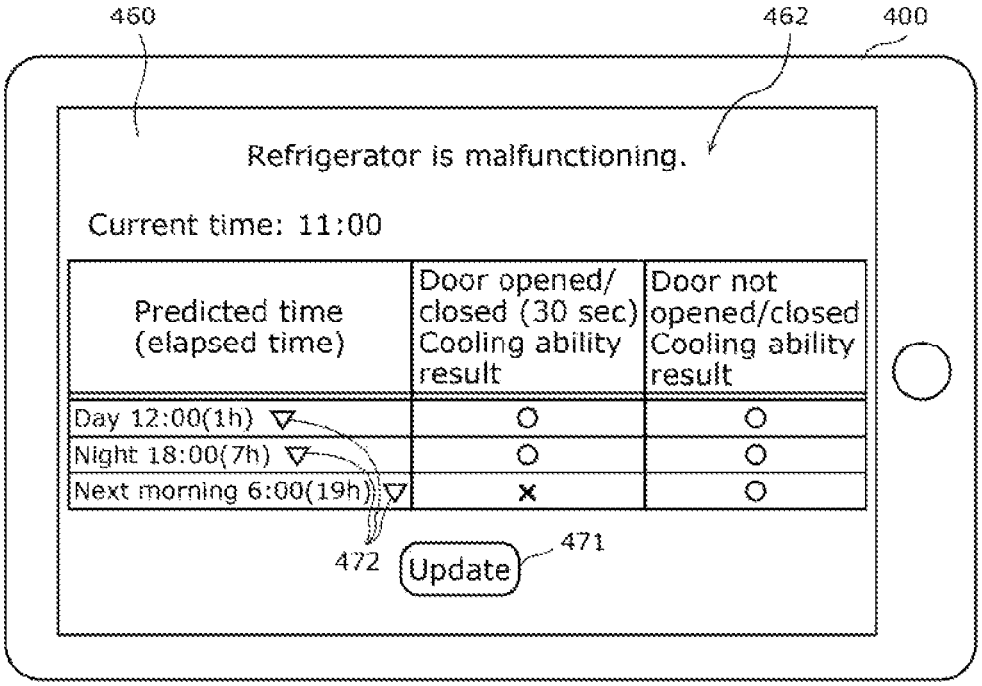
FIG. 12 is a diagram illustrating a first example of a variation on an image, displayed in the terminal device, indicating a result of calculating the interior temperature of the refrigerator, according to the embodiment.

FIG. 12 is a diagram illustrating a first example of a variation on image 462, displayed in terminal device 400, indicating a result of calculating the interior temperature of refrigerator 200, according to the embodiment.

For example, when the result information has been received via communicator 410, controller 430 causes touch panel display 460 to display image 462, indicating the calculation result from refrigerator management device 300, based on the result information.

Image 462 includes, for example, the current time; a predicted time (an elapsed time); a cooling ability result from the predicted time, for when door 280 is opened for 30 seconds up until the predicted time; and a cooling ability result from the predicted time, for when door 280 has remained closed up until the predicted time.

The cooling ability result from the predicted time, for when door 280 is opened for 30 seconds up until the predicted time, and the cooling ability result from the predicted time, for when door 280 has remained closed up until the predicted time, include whether or not the interior temperature will reach the predetermined temperature between the current time and the predicted time.

For example, image 462 includes an "x" as the cooling ability result at the predicted time for when door 280 is opened for 30 seconds, when the predicted time is 6:00 the next morning. This indicates that refrigerator management device 300 has calculated that the interior temperature will reach the predetermined temperature when door 280 is opened for 30 seconds between the current time and 6:00 the next morning.

Additionally, for example, image 462 includes an "o" as the cooling ability result at the predicted time for when door 280 remains closed for 30 seconds, when the predicted time is 6:00 the next morning. This indicates that refrigerator management device 300 has calculated that the interior temperature will not reach the predetermined temperature when door 280 remains closed between the current time and 6:00 the next morning.

Through this, the user can easily understand the interior temperature.

Additionally, image 462 may include an image for accepting an input from the user, for example. For example, image 462 includes acceptance part 471, which is an image indicating a button such as "update". For example, when the user presses acceptance part 471, controller 430 may send, to refrigerator management device 300, update request information requesting information indicating a result of determining whether or not the interior temperature will reach the predetermined temperature between the current time and the predicted time when door 280 is opened for 30 seconds, and a result of determining whether or not the interior temperature will reach the predetermined temperature between the current time and the predicted time when door 280 remains closed, according to the current time. Upon receiving the update request information, refrigerator management device 300 may recalculate the result of determining whether or not the interior temperature will reach the predetermined temperature between the current time and the predicted time when door 280 is opened for 30 seconds, and the result of determining whether or not the interior temperature will reach the predetermined temperature between the current time and the predicted time when door 280 remains closed, and send result information indicating the calculation result to terminal device 400. Terminal device 400 may update (change) the image displayed in touch panel display 460 based on the result information.

The predicted time may be changed as desired. For example, image 462 includes at least one acceptance part 472, which is an image indicating a button such as "∇". For example, when the user presses acceptance part 472, controller 430 causes touch panel display 460 to display an image indicating a plurality of times. For example, when the user presses acceptance part 472, controller 430 causes images such as "15:00 (4 h)", "21:00 (10 h)", "24:00 (13 h)", "3:00 the next morning (16 h)", and the like to be displayed. For example, when the user presses any one of the displayed times, controller 430 switches the predicted time included in image 462 to the time pressed by the user, and deletes the image showing the cooling ability result indicated by "o" or "x". Furthermore, for example, when the user presses acceptance part 471, controller 430 may send, to refrigerator management device 300, update request information requesting information indicating a result of determining whether or not the interior temperature will reach the predetermined temperature between the current time and the predicted time pressed by the user when door 280 is opened for 30 seconds, and a result of determining whether or not the interior temperature will reach the predetermined temperature between the current time and the predicted time pressed by the user when door 280 remains closed, according to the current time. Upon receiving the update request information, refrigerator management device 300 may recalculate the result of determining whether or not the interior temperature will reach the predetermined temperature between the current time and the predicted time pressed by the user when door 280 is opened for 30 seconds, and the result of determining whether or not the interior temperature will reach the predetermined temperature between the current time and the predicted time pressed by the user when door 280 remains closed, and send result information indicating the calculation result to terminal device 400. Terminal device 400 may update (change) the image displayed in touch panel display 460 based on the result information.

Note that the user may send the predicted time to refrigerator management device 300 before terminal device 400 receives the notification of an anomaly by operating terminal device 400.

[Variation 2]

Figure 13:
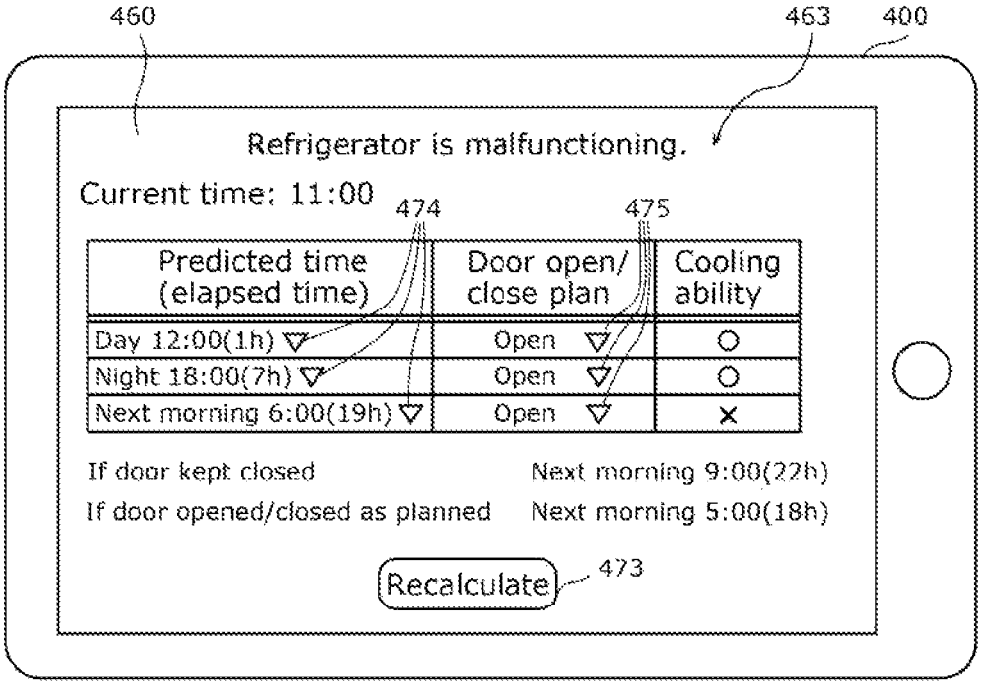
FIG. 13 is a diagram illustrating a second example of a variation on an image, displayed in the terminal device, indicating a result of calculating the interior temperature of the refrigerator, according to the embodiment.

FIG. 13 is a diagram illustrating a second example of a variation on image 463, displayed in terminal device 400, indicating a result of calculating the interior temperature of refrigerator 200, according to the embodiment.

For example, when the result information has been received via communicator 410, controller 430 causes touch panel display 460 to display image 463, indicating the calculation result from refrigerator management device 300, based on the result information.

Image 463 includes, for example, the current time, the predicted time (the elapsed time), a plan to open/close door 280, and the cooling ability result at the predicted time.

The cooling ability result includes whether or not the interior temperature will reach the predetermined temperature between the current time and the predicted time.

For example, image 463 includes an "x" as the cooling ability result at the predicted time for when there is a plan to open/close door 280, when the predicted time is 6:00 the next morning. This indicates that refrigerator management device 300 has calculated that the interior temperature will reach the predetermined temperature when door 280 is opened for a predetermined length of time (e.g., 30 seconds) between the current time and 6:00 the next morning.

Through this, the user can easily understand the interior temperature.

Additionally, image 463 may include an image for accepting an input from the user, for example. For example, image 463 includes acceptance part 473, which is an image indicating a button such as "recalculate". For example, when the user presses acceptance part 473, controller 430 may send, to refrigerator management device 300, update request information requesting information indicating a result of determining whether or not the interior temperature will reach the predetermined temperature between the current time and the predicted time, in accordance with the current time and the plan to open/close door 280. Upon receiving the update request information, refrigerator management device 300 may recalculate the result of determining whether or not the interior temperature will reach the predetermined temperature between the current time and the predicted time in accordance with the plan to open/close door 280, and send result information indicating the calculation result to terminal device 400. Terminal device 400 may update (change) the image displayed in touch panel display 460 based on the result information.

The predicted time may be changed as desired, as in Variation 1. For example, image 463 includes at least one acceptance part 474, which is an image indicating a button such as "∇". Controller 430 may execute the same processing as that of Variation 1 when the user presses acceptance part 472, for example.

Additionally, the plan to open/close the door may be capable of being changed as desired. For example, image 463 includes at least one acceptance part 475, which is an image indicating a button such as "▽ ". For example, when the user presses acceptance part 475, controller 430 causes touch panel display 460 to display an image indicating the plan to open/close, such as "will be opened", "will not be opened", or the like. For example, when the user presses any one of the displayed images indicating a plan to open/close, controller 430 switches the plan to open/close included in image 463 to the plan to open/close pressed by the user, and deletes the image showing the cooling ability result indicated by "o" or "x". Furthermore, for example, when the user presses acceptance part 473, controller 430 may send, to refrigerator management device 300, update request information requesting information indicating a result of determining whether or not the interior temperature will reach the predetermined temperature between the current time and the predicted time pressed by the user, in accordance with the plan to open/close door 280 based on the current time. Upon receiving the update request information, refrigerator management device 300 may recalculate the result of determining whether or not the interior temperature will reach the predetermined temperature between the current time and the predicted time pressed by the user in accordance with the plan to open/close door 280, and send result information indicating the calculation result to terminal device 400. Terminal device 400 may update (change) the image displayed in touch panel display 460 based on the result information.

Additionally, image 463 includes information indicating the time at which the interior temperature will reach the predetermined temperature, and an elapsed time until the interior temperature reaches the predetermined temperature from the current time, for when door 280 remains closed. In image 463, for example, "9:00 the next morning" is indicated as the time at which the interior temperature will reach the predetermined temperature, and "22 h" is indicated as the elapsed time until the interior temperature reaches the predetermined temperature from the current time, for when door 280 remains closed.

Additionally, image 463 includes information indicating the time at which the interior temperature will reach the predetermined temperature, and the elapsed time until the interior temperature reaches the predetermined temperature from the current time, for when door 280 is opened according to the plan to open/close. For example, refrigerator management device 300 calculates the time and elapsed time at which the interior temperature will reach the predetermined temperature for when door 280 is opened according to the plan to open/close, assuming that door 280 will be opened at the predicted time. In image 463, for example, "5:00 the next morning" is indicated as the time at which the interior temperature will reach the predetermined temperature, and "18 h" is indicated as the elapsed time until the interior temperature reaches the predetermined temperature from the current time, for when door 280 is opened according to the plan to open/close.

Through this, the user can easily understand the interior temperature.

[Variation 3]

Figure 14:
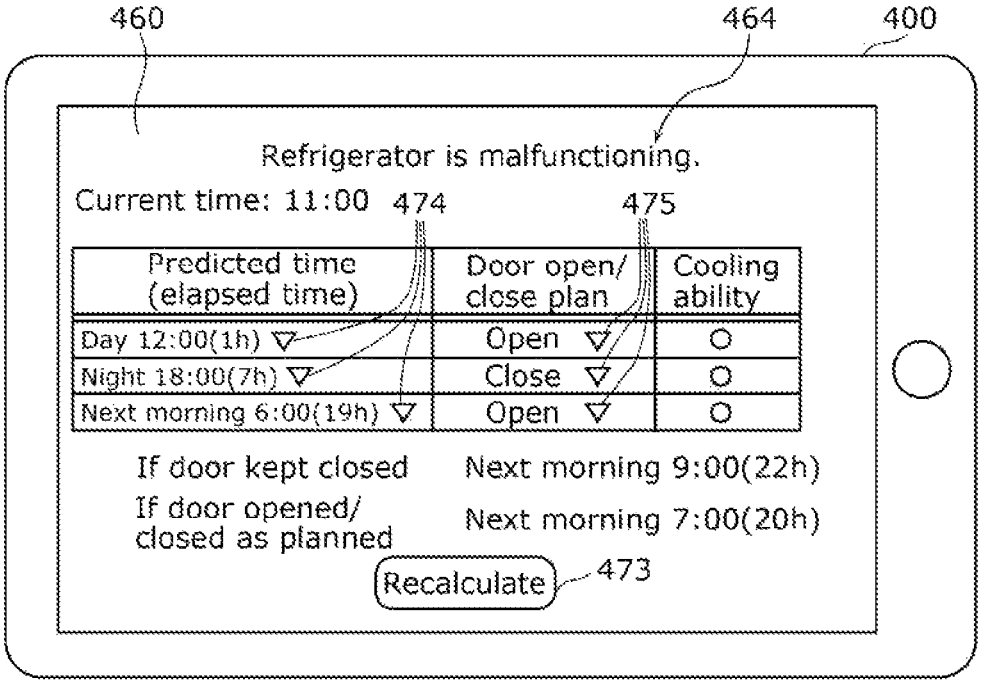
FIG. 14 is a diagram illustrating a third example of a variation on an image, displayed in the terminal device, indicating a result of calculating the interior temperature of the refrigerator, according to the embodiment.

FIG. 14 is a diagram illustrating a third example of a variation on image 464, displayed in terminal device 400, indicating a result of calculating the interior temperature of refrigerator 200, according to the embodiment.

Variation 3 differs from variation 2 in that the plan to open/close the door at a predicted time of 18:00 at night is set to "will not be opened".

In this case, in Variation 3, unlike in Variation 2, the cooling ability is "o" for the predicted time of 6:00 the next morning.

Additionally, in image 464, for example, "7:00 the next morning" is indicated as the time at which the interior temperature will reach the predetermined temperature, and "20 h" is indicated as the elapsed time until the interior temperature reaches the predetermined temperature from the current time, for when door 280 is opened according to the plan to open/close.

In this manner, by changing the predicted time and the plan to open/close door 280 as desired by operating terminal device 400, the user can easily understand the extent to which the interior temperature has cooled at a given point in time.

Effects, etc.

As described above, a refrigerator management method according to the present embodiment includes: obtaining log information including temperature information indicating an interior temperature of refrigerator 200 and opened and closed information indicating whether or not door 280 of refrigerator 200 has been opened and closed (step S201); calculating, based on the log information, a timewise change in the interior temperature for when door 280 is opened and closed in a predetermined period and for when door 280 is not opened and closed in the predetermined period (step S202); and outputting (step S203) result information indicating a calculation result of the calculating (step S202).

According to this configuration, the timewise change in the interior temperature can be calculated taking into account the effects of opening/closing door 280, which is likely to affect the interior temperature. This makes it possible to accurately calculate the timewise change in the interior temperature.

Additionally, for example, refrigerator 200 includes compressor 260. In this case, the log information further includes the compressor operation information indicating the operation state of compressor 260. In this case, the calculating (step S201) includes calculating, based on the log information, a timewise change in the interior temperature of refrigerator 200 for when door 280 is opened and closed and for when door 280 is not opened and closed in a case where compressor 260 is stopped.

According to this configuration, the timewise change in the interior temperature can be calculated using a state in which compressor 260 is not cooling the interior. Accordingly, for example, when calculating the timewise change in the interior temperature when refrigerator 200 has lost its cooling function, the timewise change in the interior temperature can be calculated even more accurately.

Additionally, for example, the refrigerator management method according to the embodiment further includes sensing at least one of a malfunction of refrigerator 200 or a stop in the supply of power to refrigerator 200 (step S105). In this case, the outputting (step S203) includes outputting the result information after the sensing of at least one of a malfunction of refrigerator 200 or a stop in the supply of power to refrigerator 200 in the sensing (step S105).

According to this configuration, when refrigerator 200 has lost its cooling function, i.e., when the interior temperature begins to rise and may adversely affect food items and the like inside, the user can be properly informed of the interior state.

Additionally, for example, the refrigerator management method according to the embodiment further includes obtaining timing information indicating a timing at which door 280 is expected to be opened and closed (e.g., step S107). In this case, the calculating (step S202) includes calculating a timewise change in the interior temperature for when door 280 is opened and closed at the timing indicated by the timing information obtained in the obtaining of the timing information.

According to this configuration, the timewise change in the interior temperature can be calculated for when door 280 is opened and closed at a desired timing. Accordingly, for example, the timewise change in the interior temperature can be calculated for when door 280 is opened and closed at the user's desired timing. This improves the convenience.

Additionally, for example, the refrigerator management method according to the embodiment further includes determining whether or not the interior temperature will exceed a predetermined temperature at a predetermined time based on the timewise change in the interior temperature calculated in the calculating (step S202). In this case, the outputting (step S203) includes outputting a determination result of the determining (the determination result information). In this case, for example, the outputting includes including the determination result information in the result information and outputting the result information. The determining is executed between step S202 and step S203, for example.

According to this configuration, it is easier for the user to understand the state of the interior temperature. This further improves the convenience.

Additionally, for example, the refrigerator management method according to the embodiment further includes obtaining time information indicating the predetermined time (e.g., step S107).

According to this configuration, the timewise change in the interior temperature can be calculated for a user's desired time, for example. This further improves the convenience.

Additionally, for example, the refrigerator management method according to the embodiment further includes estimating, based on the timewise change in the interior temperature calculated in the calculating (step S202), a maximum length of time from when at least one of the malfunction of refrigerator 200 or the stop in supply of power to refrigerator 200 is sensed in the sensing (step S105) to when the interior temperature exceeds a predetermined temperature. In this case, the outputting (step S203) includes outputting the maximum length of time estimated in the estimating (the maximum length of time information). In this case, for example, the outputting includes including the maximum length of time information in the result information and outputting the result information. The estimating is executed between step S202 and step S203, for example.

According to this configuration, it is easier to understand how long the quality of the food items and the like stored inside can be maintained. This further improves the convenience.

Additionally, for example, the outputting (step S203) includes outputting malfunction information indicating the calculation result from calculator 340 and at least one of an indication that a malfunction of refrigerator 200 has been sensed or an indication that no power is being supplied to refrigerator 200.

According to this configuration, the user can immediately know that refrigerator 200 has lost its cooling function. Accordingly, immediate action can be taken, such as repairing refrigerator 200 or consuming the food items inside. This further improves the convenience.

Additionally, refrigerator management device 300 according to the embodiment includes: obtainer 330 that obtains log information including temperature information indicating an interior temperature of refrigerator 200 and opened and closed information indicating whether or not door 280 of refrigerator 200 has been opened and closed; calculator 340 that calculates, based on the log information obtained by obtainer 330, a timewise change in the interior temperature for when door 280 is opened and closed and for when door 280 is not opened and closed; and outputter 350 that outputs result information indicating a calculation result calculated by calculator 340.

According to this configuration, the timewise change in the interior temperature can be calculated taking into account the effects of opening/closing door 280, which is likely to affect the interior temperature. This makes it possible to accurately calculate the timewise change in the interior temperature.

Additionally, refrigerator management system 100 according to the embodiment includes refrigerator 200, refrigerator management device 300 capable of communicating with refrigerator 200, and terminal device 400 capable of communicating with the refrigerator management device. Refrigerator 200 includes: detector 230 that detects log information including temperature information indicating an interior temperature of refrigerator 200 and opened and closed information indicating whether or not door 280 of refrigerator 200 has been opened and closed; and transmitter 240 that transmits the log information detected by detector 230 to refrigerator management device 300. Refrigerator management device 300 includes: obtainer 330 that obtains the log information transmitted from transmitter 240; calculator 340 that calculates, based on the log information obtained by obtainer 330, a timewise change in the interior temperature for when door 280 is opened and closed and for when door 280 is not opened and closed; and outputter 350 that outputs result information indicating a calculation result calculated by calculator 340. Terminal device 400 includes notifier 440 that makes a notification of the calculation result based on the result information output from outputter 350.

According to this configuration, the timewise change in the interior temperature can be calculated taking into account the effects of opening/closing door 280, which is likely to affect the interior temperature. This makes it possible to accurately calculate the timewise change in the interior temperature.

Note that the present invention may be realized as a temperature calculation method that calculates an interior temperature of refrigerator 200 based on an operation state of compressor 260. The temperature calculation method may be executed by refrigerator management device 300, for example.

Figure 15:
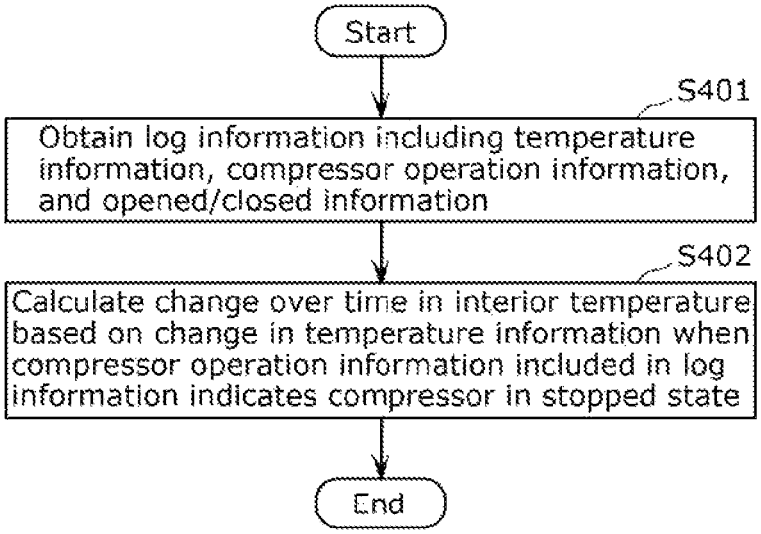
FIG. 15 is a flowchart illustrating a temperature calculation method according to the embodiment.

FIG. 15 is a flowchart illustrating the temperature calculation method according to the embodiment.

First, obtainer 330 of refrigerator management device 300 obtains log information including temperature information indicating an interior temperature of refrigerator 200 including compressor 260, compressor operation information indicating the operation state of compressor 260 (e.g., whether compressor 260 is operating or is stopped), and opened and closed information indicating whether or not door 280 of refrigerator 200 has been opened and closed (step S401).

Next, calculator 340 of refrigerator management device 300 calculates a timewise change in the interior temperature based on a change in the temperature information when the compressor operation information included in the log information indicates a stopped state of compressor 260 (step S402).

In this manner, the temperature calculation method according to the embodiment includes: obtaining log information including temperature information indicating an interior temperature of refrigerator 200 including compressor 260, compressor operation information indicating the operation state of compressor 260, and opened and closed information indicating whether or not door 280 of refrigerator 200 has been opened and closed (step S401); and calculating a timewise change in the interior temperature based on a change in the temperature information when the compressor operation information included in the log information indicates a stopped state of compressor 260 (step S402).

According to this configuration, based on the operation state of compressor 260 (e.g., whether or not compressor 260 is operating), the timewise change in the interior temperature can be calculated taking into account the effects of opening/closing door 280, which is likely to affect the interior temperature of refrigerator 200. This makes it possible to accurately calculate the timewise change in the interior temperature.

OTHER EMBODIMENTS

Although a refrigerator management method and the like according to the present invention have been described thus far on the basis of an embodiment, the present invention is not limited to the foregoing embodiment.

For example, in the foregoing embodiment, some or all of the constituent elements of processors such as detector 230, malfunction sensor 221, and the like included in refrigerator 200 may be constituted by dedicated hardware, or may be realized by executing software programs suited to each constituent element. Each constituent element may be realized by a program executing unit such as a CPU or a processor reading out and executing a software program recorded into a recording medium such as an HDD (Hard Disk Drive) or semiconductor memory.

Additionally, for example, the constituent elements of each processor may be constituted by one or more electronic circuits. The one or more electronic circuits may be generic circuits, or may be dedicated circuits.

The one or more electronic circuits may include semiconductor devices, ICs (Integrated Circuit), LSI (Large Scale Integration) circuits, or the like, for example. The ICs or LSI circuits may be integrated on a single chip, or may be integrated on a plurality of chips. Although the terms IC and LSI are used here, the terminology differs depending on the degree of integration, and may therefore be called system LSI, VLSI (Very Large Scale Integration), or ULSI (Ultra Large Scale Integration). An FPGA (Field Programmable Gate Array), which is programmed after an LSI circuit is manufactured, can be used for the same purpose.

The same applies to refrigerator management device 300 and terminal device 400.

Additionally, in the foregoing embodiment, refrigerator management device 300 is a server device, and is communicatively connected to refrigerator 200 and terminal device 400 over network 500. However, refrigerator 200, refrigerator management device 300, and terminal device 400 may be formed in an integrated manner. For example, the functional configuration of at least one of refrigerator management device 300 or terminal device 400 may be provided in refrigerator 200.

Additionally, for example, when the functional configuration of at least one of refrigerator management device 300 or terminal device 400 is provided in refrigerator 200, some or all of the constituent elements of the processors, such as detector 230 included in refrigerator 200, calculator 340 included in refrigerator management device 300, controller 430 included in terminal device 400, and the like, may be constituted by dedicated hardware, or may be realized by executing software programs suited to each constituent element. Each constituent element may be realized by a program executing unit such as a CPU or a processor reading out and executing a software program recorded into a recording medium such as an HDD (Hard Disk Drive) or semiconductor memory.

The general or specific forms of the present invention may be implemented as systems, devices, methods, integrated circuits, or computer programs. These forms may instead be implemented by a computer-readable non-transitory recording medium, such as an optical disk, an HDD, semiconductor memory, or the like, in which the computer program is stored. These forms may also be implemented by any desired combination of systems, devices, methods, integrated circuits, computer programs, and recording media.

Additionally, variations on the present embodiment conceived by one skilled in the art and embodiments implemented by combining constituent elements from different other embodiments, for as long as they do not depart from the essential spirit of the present invention, fall within the scope of the present invention.

INDUSTRIAL APPLICABILITY

The present invention can be applied in a management device communicatively connected to a refrigerator, and to a refrigerator management system including the refrigerator and the management device.

The invention claimed is:

1. A refrigerator management method, comprising:
obtaining log information including temperature information indicating an interior temperature of a refrigerator and opened and closed information indicating whether or not a door of the refrigerator has been opened and closed;
calculating, based on the log information, a first future timewise change in the interior temperature for when the door is opened and closed in a predetermined future period and a second future timewise change in the interior temperature for when the door is not opened and closed in the predetermined future period; and
outputting result information indicating a calculation result of the calculating.

2. The refrigerator management method according to claim 1,
wherein the refrigerator includes a compressor,
the log information further includes compressor operation information indicating an operation state of the compressor, and
the calculating includes calculating, based on the log information, the first future timewise change in the interior temperature for when the door is opened and closed and the second future timewise change in the interior temperature for when the door is not opened and closed, in a case where the compressor is stopped.

3. The refrigerator management method according to claim 1, further comprising:
sensing at least one of a malfunction of the refrigerator or a stop in supply of power to the refrigerator,
wherein the outputting includes outputting the result information after the sensing of at least one of a malfunction of the refrigerator or a stop in supply of power to the refrigerator in the sensing.

4. The refrigerator management method according to claim 3, further comprising:
obtaining timing information indicating a future timing at which the door is expected to be opened and closed,
wherein the calculating includes calculating the first future timewise change in the interior temperature for when the door is opened and closed at the future timing indicated by the timing information obtained in the obtaining of the timing information.

5. The refrigerator management method according to claim 3, further comprising:
determining whether or not the interior temperature will exceed a predetermined temperature at a predetermined time based on the first and second timewise changes in the interior temperature calculated in the calculating,
wherein the outputting includes outputting a determination result of the determining.

6. The refrigerator management method according to claim 5, further comprising:
obtaining time information indicating the predetermined time.

7. The refrigerator management method according to claim 3, further comprising:
estimating, based on the first and second timewise changes in the interior temperature calculated in the calculating, a maximum length of time from when at least one of the malfunction of the refrigerator or the stop in supply of power to the refrigerator is sensed in the sensing to when the interior temperature exceeds a predetermined temperature,
wherein the outputting includes outputting the maximum length of time estimated in the estimating.

8. The refrigerator management method according to claim 3,
wherein the outputting includes outputting malfunction information indicating at least one of an indication that a malfunction of the refrigerator has been sensed or an indication that no power is being supplied to the refrigerator.

9. A refrigerator management device, comprising:
an obtainer that obtains log information including temperature information indicating an interior temperature of a refrigerator and opened and closed information indicating whether or not a door of the refrigerator has been opened and closed;
a calculator that calculates, based on the log information obtained by the obtainer, a first future timewise change in the interior temperature for when the door is opened and closed in a predetermined future period and a second future timewise change in the interior temperature for when the door is not opened and closed in the predetermined future period; and
an outputter that outputs result information indicating a calculation result calculated by the calculator.

10. A refrigerator management system, comprising:
a refrigerator;
a refrigerator management device capable of communicating with the refrigerator; and
a terminal device capable of communicating with the refrigerator management device, wherein the refrigerator includes:
a detector that detects log information including temperature information indicating an interior temperature of the refrigerator and opened and closed information indicating whether or not a door of the refrigerator has been opened and closed; and a transmitter that transmits the log information detected by the detector to the refrigerator management device, the refrigerator management device includes:

an obtainer that obtains the log information transmitted from the transmitter;

a calculator that calculates, based on the log information obtained by the obtainer, a first future timewise change in the interior temperature for when the door is opened and closed in a predetermined period and a second future timewise change in the interior temperature for when the door is not opened and closed in the predetermined period; and an outputter that outputs result information indicating a calculation result calculated by the calculator, and the terminal device includes a notifier that makes a notification of the calculation result based on the result information output from the outputter.

11. A temperature calculation method, comprising:

obtaining log information including temperature information indicating an interior temperature of a refrigerator including a compressor, compressor operation information indicating an operation state of the compressor, and opened and closed information indicating whether or not a door of the refrigerator has been opened and closed; and calculating a future timewise change in the interior temperature based on a change in the temperature information when the compressor operation information included in the log information indicates a state in which the compressor is not operating out of a state in which the compressor is operating and the state in which the compressor is not operating.

* * * * *